US005615462A

United States Patent [19]

Goto

[11] Patent Number: 5,615,462

[45] Date of Patent: Apr. 1, 1997

[54] CONNECTOR FOR COUPLING A HARNESS AND A STRINGED INSTRUMENT

[75] Inventor: Takao Goto, Gunma-ken, Japan

[73] Assignee: Gotoh Gut Yugen Kaisha, Gunma-ken, Japan

[21] Appl. No.: 661,727

[22] Filed: Jun. 11, 1996

[30] Foreign Application Priority Data

Jun. 21, 1995 [JP] Japan ..... 7-189687

[51] Int. Cl.[6] ..... G10G 5/00

[52] U.S. Cl. ..... 24/608; 24/604; 24/607; 224/257

[58] Field of Search ..... 24/608, 607, 606, 24/604; 225/257

[56] References Cited

U.S. PATENT DOCUMENTS

| | | | |
|---|---|---|---|
| 3,894,464 | 7/1975 | Brooks | 224/257 |
| 4,144,794 | 3/1979 | Silverman et al. . | |
| 4,274,181 | 6/1981 | Schaller | 224/257 |
| 4,901,900 | 2/1990 | Goto . | |

FOREIGN PATENT DOCUMENTS

| | | |
|---|---|---|
| 59-5168 | 2/1984 | Japan . |
| 63-168491 | 11/1988 | Japan . |
| 7-43539 | 8/1995 | Japan . |

*Primary Examiner*—Victor N. Sakran
*Attorney, Agent, or Firm*—Wenderoth, Lind & Ponack

[57] ABSTRACT

A connector for releasably connecting a harness to a stringed instrument. The connector includes an engaging member provided on terminal ends of the harness and a receiving member provided on opposite ends of the stringed instrument body. The connector is operated by rotation of a knob fixed on the engaging member to engage and release the receiving member. An insertion cylinder is provided on the engaging member and includes a pair of diametrically opposed engaging elements which are pivotally mounted therein. The engaging elements are dimensioned so as to engage a fitting groove on an inner peripheral wall of a receiving cylinder of the receiving member. The knob provided on the engaging member is limited to rotation through a predetermined angle. A rotatable shaft extends into the insertion cylinder and can be positioned to engage the engaging elements. The rotatable shaft has a lower cross-sectional shape which has a large diameter and a small diameter. Thus, depending upon the rotational position of the rotary shaft, the engaging elements are alternatively engaged with or disengaged from the fitting groove. Also, in the engaged position, the engaging member and the receiving member are relatively rotatable.

21 Claims, 6 Drawing Sheets

CONNECTOR FOR COUPLING A HARNESS AND A STRINGED INSTRUMENT

BACKGROUND OF THE INVENTION

The present invention relates to a connector for connecting, in particular, a harness to a stringed instrument such as a guitar.

A conventional connector is disclosed in Japanese Patent Publication No. 59-5168. The disclosed connector is of the push button type and is constructed so that an engaging member, which includes a ball, extends at a right angle relative to an axial direction of the engaging member. To form the connection, the ball is inserted into and engaged by a receiving member. Due to the necessity of several parts, the construction of the connector is complicated. Also, another problem is that a push button is subject to being inadvertently actuated during playing of the instrument which leads to disengagement of the connector.

In view of the problems associated with the above connector, a connector as disclosed in Japanese Utility Model Application Publication No. 63-168491 has been proposed. This connector has a manually operated engaging member fixed to a fastening end of a harness and a receiving member fixed to a stringed instrument. The connector is adapted to engage with or disengage from the receiving member by operation of the manually operated engaging member. The connector also includes a rotatable knob for establishing a connection between the engaging member and the receiving member. Accordingly, the problems encountered with the push button type connector are avoided. However, since the construction of the connector requires that the engaging member be actuated by rotation of the knob, it is therefore necessary to provide a drive transmission mechanism between the knob and the engaging member to convert rotation of the knob into opening and closing movements of the engaging member. Accordingly, the connector is a complex mechanism which requires several parts. Such a construction results in unacceptably high manufacturing costs. Also, the size of the connector cannot be reduced.

SUMMARY OF THE INVENTION

Therefore, an object of the present invention is to provide a connector having an engaging member and a receiving member which are of reduced size from that disclosed in the prior art. A further object is to allow engagement and release of the receiving member by rotation of a knob directly coupled to the engaging member.

In order to achieve the above-mentioned objectives, the present invention includes an engaging member having an insertion cylinder with a pair of engaging elements pivotally attached thereto. A rotatable shaft extends through the center of the insertion cylinder and, in one rotary position, the shaft engages and pushes the engaging elements outwardly relative to the insertion cylinder.

A knob is mounted on the rotatable shaft of the engaging member to facilitate rotation thereof. The shaft and the base cylinder are provided with means to limit rotation of the shaft through a predetermined angle between an engaging position and a disengaging or insertion position. In the normal or engaging position of the knob, a large diameter portion of the rotatable shaft is aligned with and in direct contact with engaging elements. Upon rotation of the knob from the normal position, a small diameter portion of the rotatable shaft is brought into alignment with the engaging members so as to disengage the elements and permit inward movement thereof.

When the small diameter portion is aligned with the engaging elements, the insertion cylinder can be inserted into a receiving cylinder to form a connection. The rotatable knob is released upon engagement of the insertion cylinder in the receiving cylinder, to thereby allow rotation of the rotating shaft back to a normal position to force the engaging members outwardly into contact with a fitting groove provided in the receiving cylinder.

In accordance with the present invention, the engaging elements are engaged and disengaged from the fitting groove of the receiving cylinder by rotation of the knob. This construction prevents inadvertent operation of the connector during playing of the associated instrument. Also, the engaging members can be engaged and disengaged by the relative alignment of the rotatable shaft and the engagement members. This arrangement results in a simplified construction which is less costly to manufacture and to market.

BRIEF DESCRIPTION OF THE DRAWINGS

Other features and objects of the invention will become apparent from the following detailed description, taken in conjunction with the accompanying drawings, which illustrate, by way of example, the features of the invention.

DETAILED DESCRIPTION OF THE INVENTION

Figure 1:
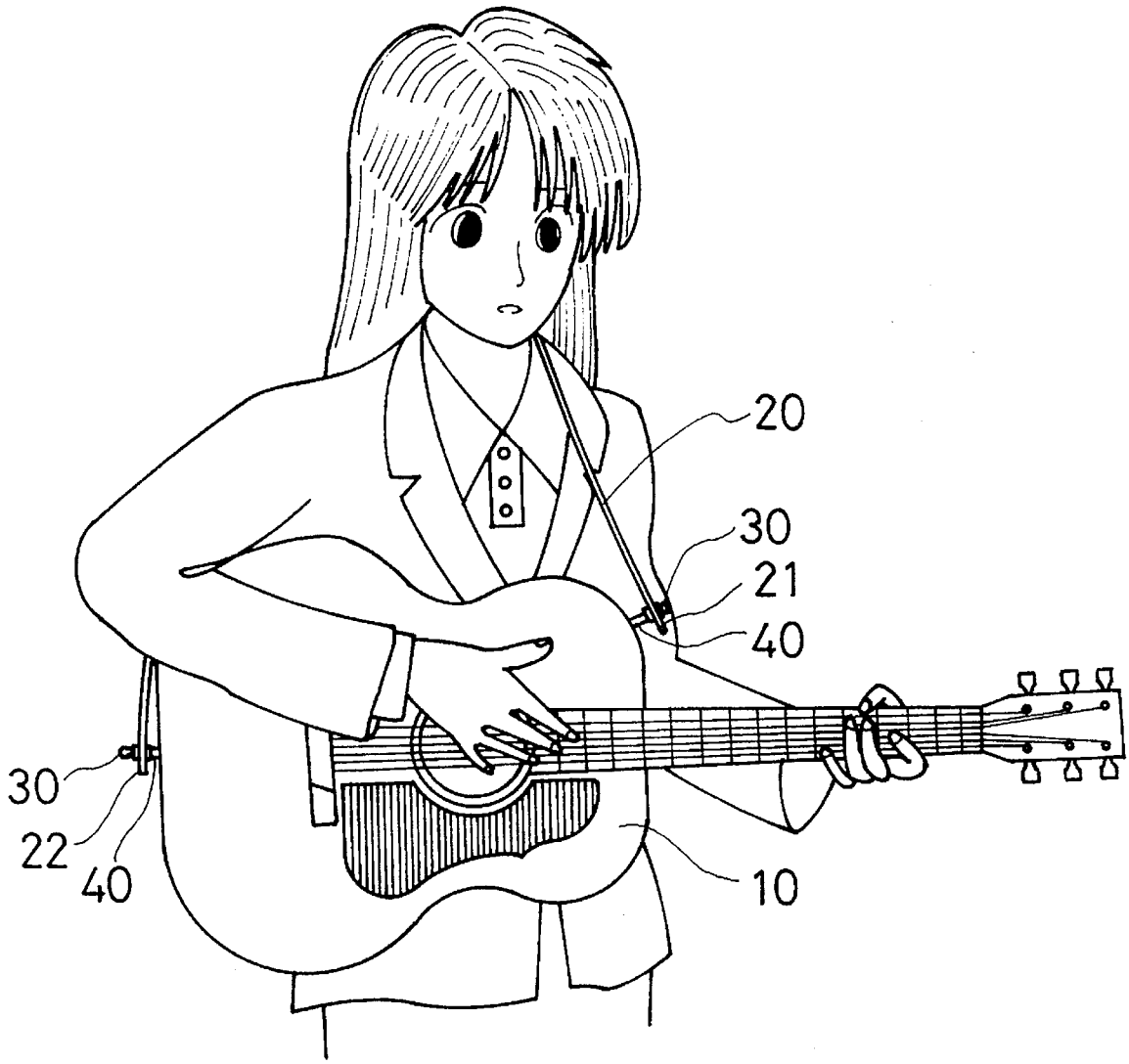
FIG. 1 is a perspective view illustrating an application of a connector in accordance with the present invention.

A particular application of the present invention is shown in FIG. 1, where a harness 20 is connected to an instrument 10, such as a guitar or the like. As shown in FIG. 1, terminal ends 21, 22 of the harness are connected to front and rear portions of the instrument 10, respectively. An engaging member 30 and a receiving member 40 together form the connector for coupling the terminal ends 21, 22 of the harness and the instrument.

Figure 2:
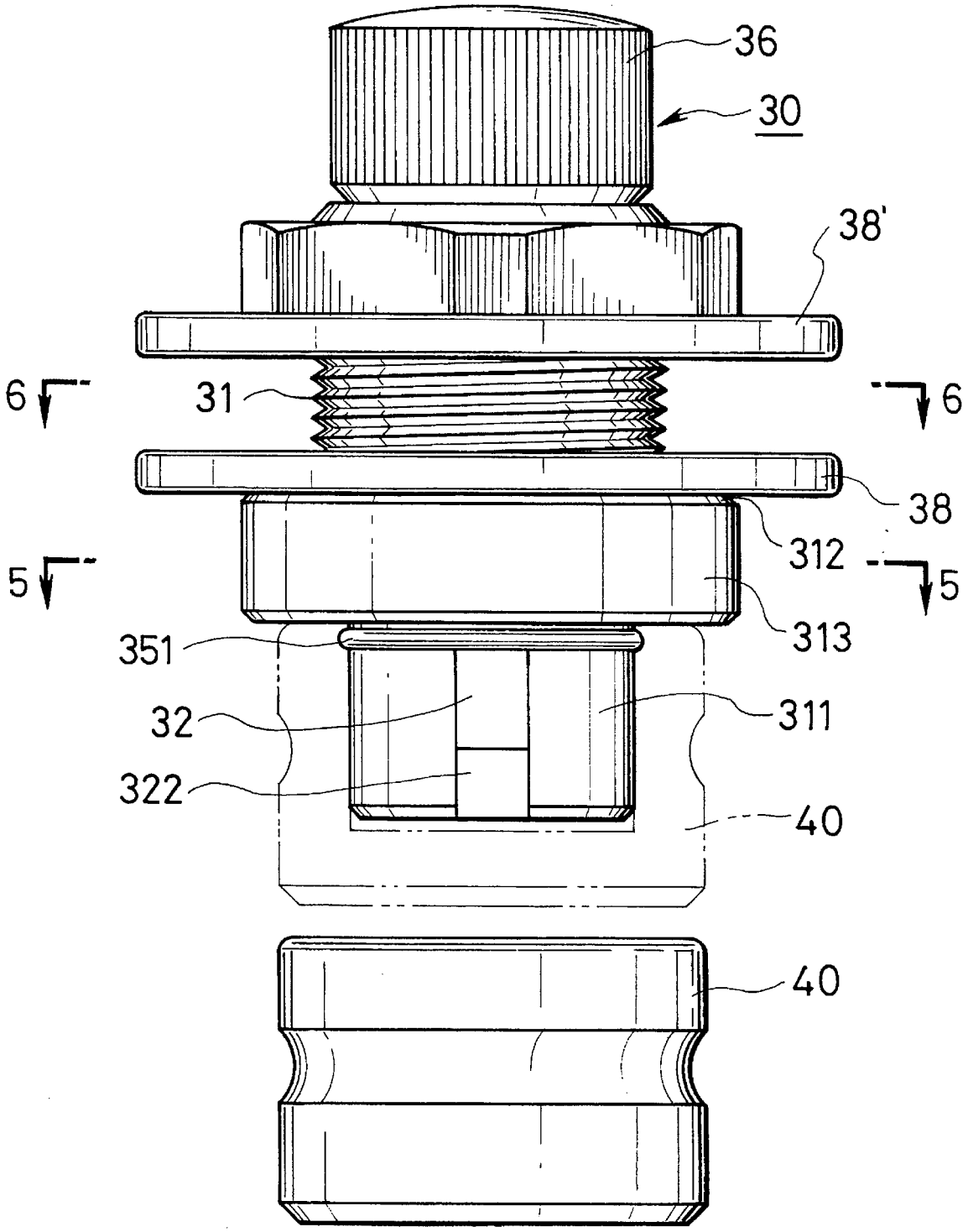
FIG. 2 is a side elevation view of the connector shown in a disengaged state.

The details of the engaging member 30 and the receiving member 40 will now be described with reference to FIGS. 2–4. The engaging member 30 includes a base cylinder 31, a rotatable shaft 33, a knob 36 mounted on an upper end of the rotatable shaft, and a hollow cylinder 311 which receives a lower end of the rotatable shaft 33.

The engaging member 30 further includes a means for attaching to a harness 20. As shown in FIGS. 2–4, the attaching means may include a first flange 38 and a second flange 38'. The first flange 38 is fixed to the base cylinder 31 and the second flange 38' is threaded onto a threaded outer peripheral surface of base cylinder 31. The harness 20 is attached to the engaging member 30 by positioning an end of the harness between the flanges and rotating the second flange 38' to move it toward the first flange 38 in order to clamp the harness therebetween.

The hollow cylinder 311 includes diametrically opposed through holes in the form of windows 311*a*, 311*b*. An engaging element 32 is pivotally mounted within each of the windows 311*a*, 311*b*.

Each of the engaging elements 32 is formed with an upper end 321 and a lower fastening end 322. The ends of each of the engaging elements have arc shapes which protrude radially outwardly of the engaging elements 32. The upper end 321 is engaged with a fastening part 35, formed in an inner wall of base cylinder 31, by means of a pivot shaft 352.

The rotatable shaft 33 is normally rotationally biased into a predetermined position relative to the engaging elements by means of a coil spring 34. The coil spring 34, as shown in FIG. 3, is positioned around the rotatable shaft 33. One end of the coil spring 34 is secured to a lower surface of the knob 36 by means of a pin, while the other end is secured to the base cylinder 31 by means of a pin fixed at a point P. Accordingly, the spring biases the rotatable shaft 33 from the point P into the normal or engaged position shown in FIGS. 3–5 and 7. The rotatable shaft can be positioned as shown in FIG. 8 by manual rotation of the knob 36 against the biasing force of the coil spring. When the knob is released the rotatable shaft 33 will automatically return to the normal position due to the restoration force of the coil spring 34.

Figure 6:
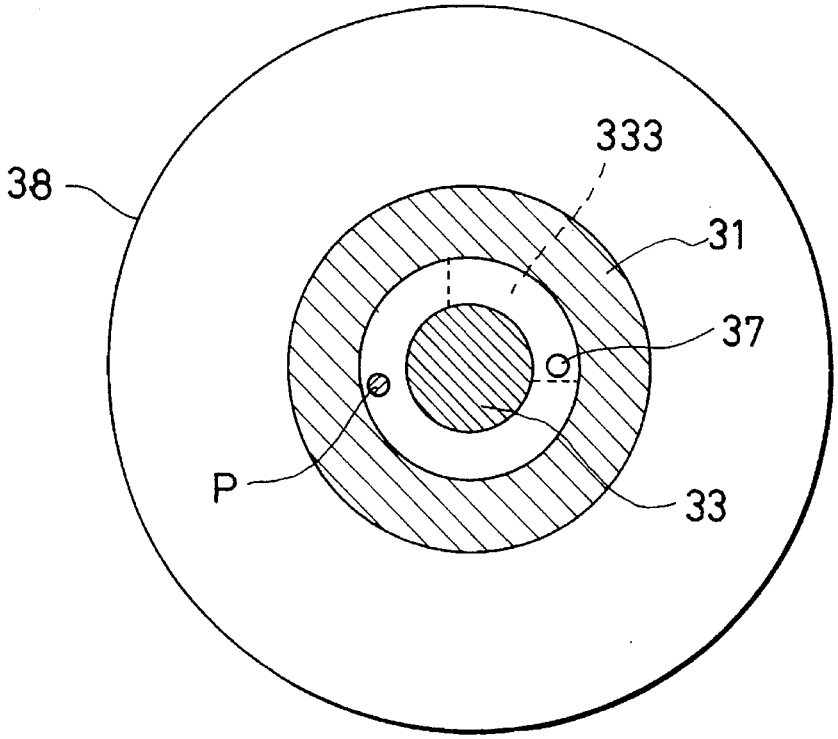
FIG. 6 is a cross-sectional view taken along line 6—6 in FIG. 2.

A means for limiting rotation of the rotary shaft 33 is provided between the rotary shaft 33 and the base cylinder 31. The rotation limiting means may take the form of a stopper 37 and a notch 333 for receiving the stopper 37. As shown in FIGS. 3, 4 and 6, the stopper 37 is fixedly connected to an inner periphery of base cylinder 31 and the notch 333 is formed in an external peripheral surface of the rotatable shaft 37. As described above, the coil spring 34 biases the rotatable shaft 33 into a position where an end wall of the notch 333 contacts the stopper 37 to define the predetermined position or normal rotational position. Also, the knob 36 can be rotated, against the biasing force of the spring 34, to a second predetermined position, defined by engagement of the stopper 37 with the other end wall of the notch 333. The angular extent of the notch 333 defines the full rotation angle of the rotatable shaft 33.

Figure 5:
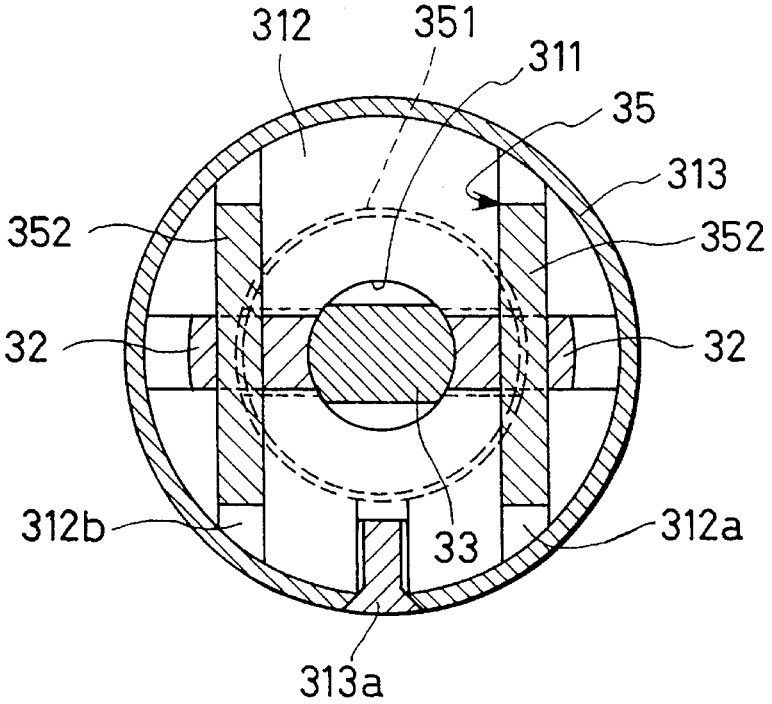
FIG. 5 is a cross-sectional view taken along line 5—5 in FIG. 2.
Figure 7:
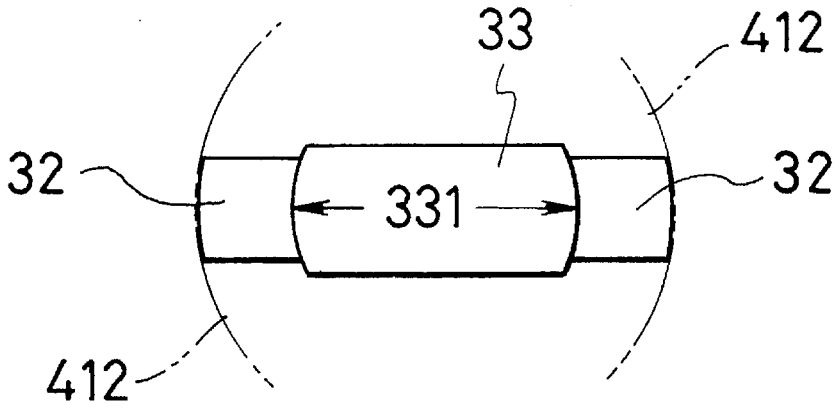
FIG. 7 is a view illustrating a rotatable shaft and corresponding engagement elements in an engaged position of the connector.
Figure 8:
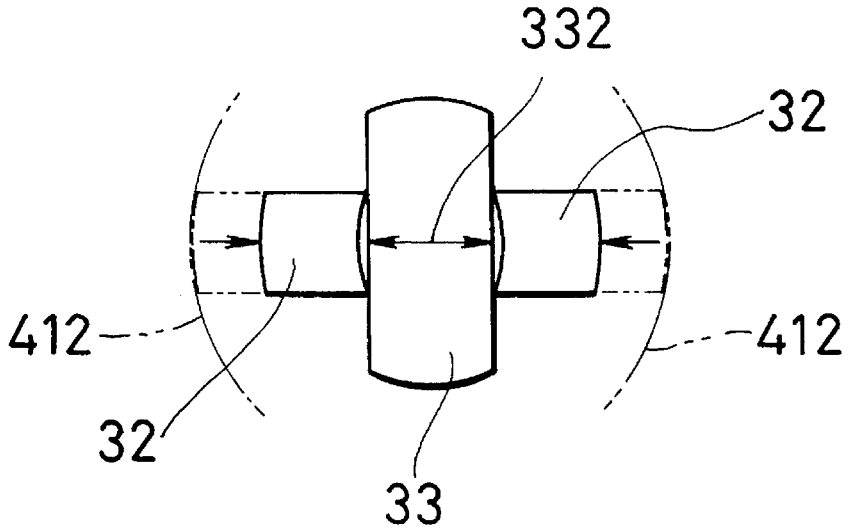
FIG. 8 is a view of the rotatable shaft and engagement members with the rotatable shaft rotated through a predetermined angle relative to the position shown in FIG. 7.

Further, as shown in FIGS. 5, 7 and 8, the rotatable shaft 33 includes a lower portion which is rotatably received in cylinder 311. The lower end portion of rotatable shaft 33 has a cross-section approximately in the shape of an elongated rectangle with opposing curved sides which correspond to the interior peripheral surface of the insertion cylinder 311. The two curved sides are interconnected by two longer sides, thereby defining a large diameter portion 331 and a small diameter portion 332. When the large diameter portion of the rotatable shaft 33 is aligned with the engaging elements 32, the curved surfaces of the rotatable shaft 33 contact engaging elements 32 to pivot them outwardly into windows 311*a*, 311*b*.

The rotation limiting means ensures that the rotatable shaft 33 is orientated accurately relative to the engaging elements 32, i.e. the large diameter portion of the rotatable shaft lower end is aligned with the engaging members 32 in the rest or normal position, and the small diameter portion of the rotatable shaft lower end is aligned with the engaging members upon rotation of the knob 36 through the predetermined angle, which in the illustrated embodiment is 90°.

The outward pivotal motion of the engaging elements 32 is controlled by a position regulating means provided on the insertion cylinder 311. The position regulating means may include a ring 351 positioned on the external peripheral surface of the insertion cylinder 311 for contacting the engaging elements 32 upon outward pivotal motion thereof, as shown in FIGS. 2 and 3.

Figure 3:
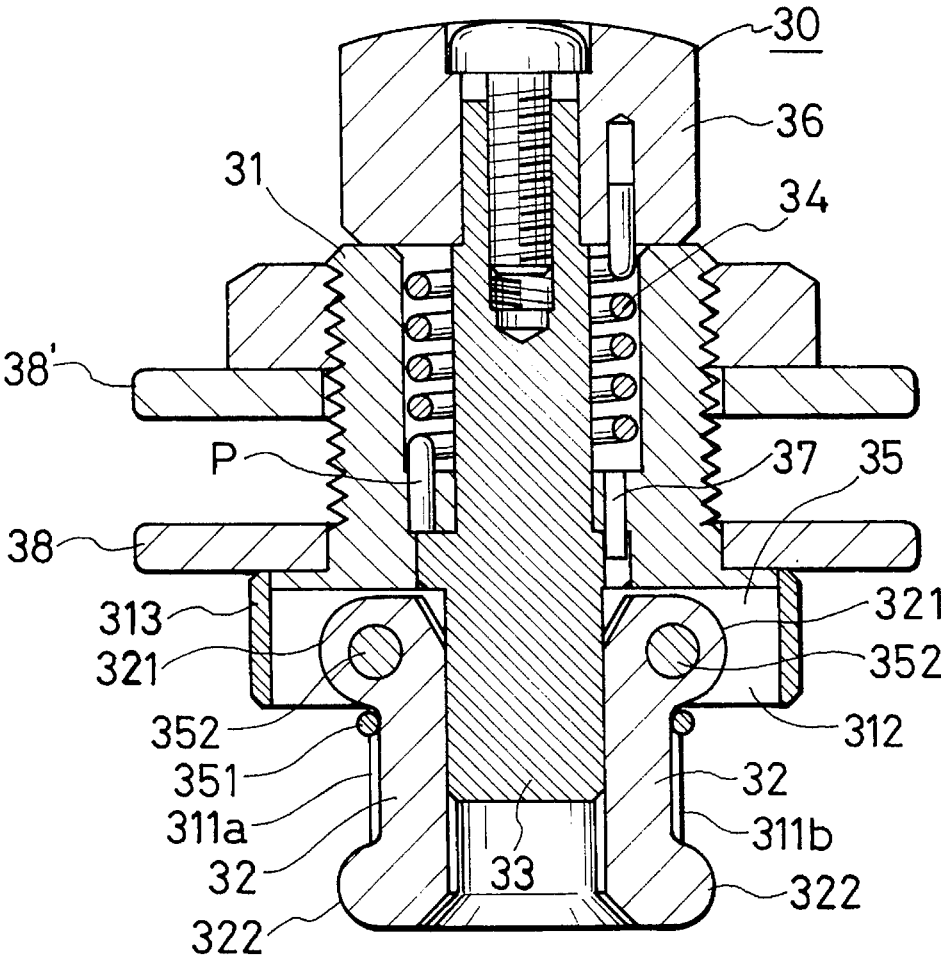
FIG. 3 is a cross-sectional front view of the connector illustrated in FIG. 2.
Figure 3:
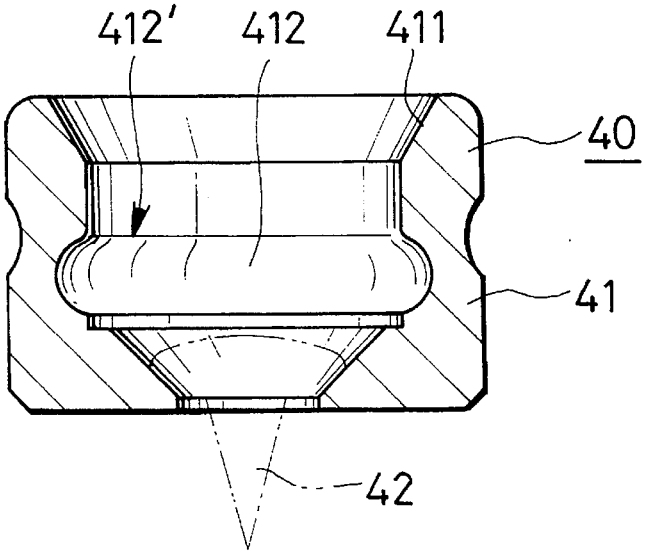
Figure 4:
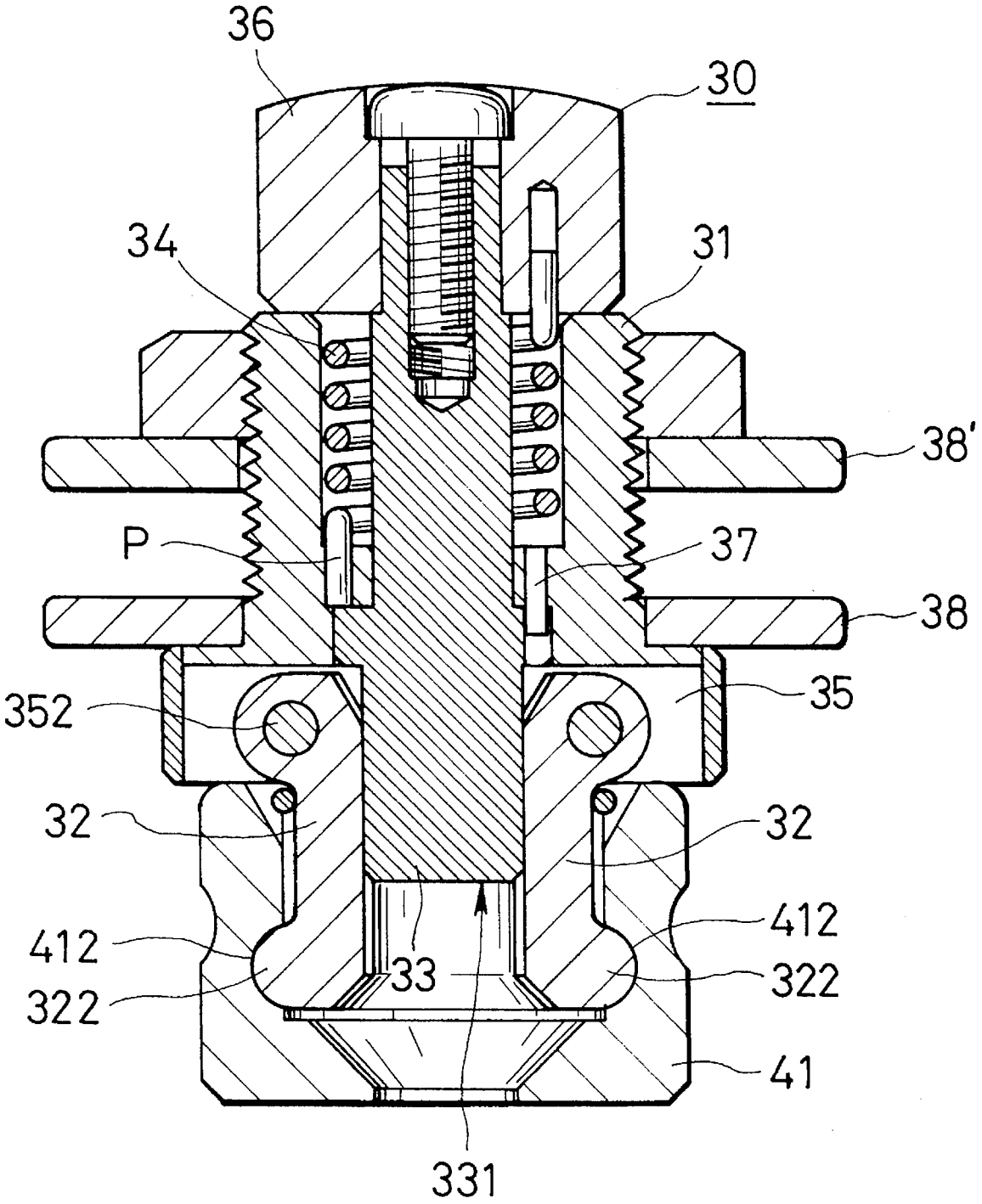
FIG. 4 is a cross-sectional front view of the connector of FIG. 2 in an engaged state.

A receiving member 40, as shown in FIGS. 3 and 4, forms the female member of the connector and includes a receiving cylinder 41 having an open receiving end. The open receiving end of the cylinder 41 is defined by a tapered guide edge 411. A fitting groove 412 is formed in an inner peripheral wall of the cylinder 41. The opposite end of the engaging cylinder 41 is adapted to receive a means 42 for mounting the cylinder 41 to an associated string instrument. The mounting means 42 may include a wood screw or the like.

An open upper edge 412' of the fitting groove 412 forms a constricted passage which is dimensioned to allow the lower fastening end 322 of the engaging member 32 to pass only when the small portion 332 of the rotatable shaft lower end is aligned with the engaging members 32 (FIG. 8).

The operation of the connector of the present invention, constructed in accordance with the above description, will now be described.

The engaging members 30 are attached to the terminal ends 21, 22 of harness 20 and the associated receiving members 40 are attached to the opposite ends of the instrument body.

In order to couple the engaging member 30 and the receiving member 40, knob 36 is rotated through a predetermined angle until stopper 37 engages an end wall of notch 333. The insertion cylinder 311 is then inserted into receiving member 40. As lower end 322 passes over upper edge 412' of fitting groove 412, knob 36 is released and spring 34 biases the rotatable shaft 33 so that the large diameter portion 331 is aligned with engaging elements 32. In this position, lower ends 322 of engaging elements are securely positioned in the fitting groove 412 as shown in FIG. 4.

Further, as shown in FIG. 7, engaging elements 32 are forced into contact with ring 351 by the large diameter portion 331 of rotatable shaft 33.

In order to release the instrument 10 from the harness 20, i.e. remove the insertion cylinder 311 from engaging cylinder 41, knob 36 is rotated against the biasing force of spring means 34 to cause the rotatable shaft 33 to be rotated through the predetermined angle away from the normal or rest position. Accordingly, the pressure exerted on engaging elements 32 by the large diameter portion 331 of rotatable shaft 33 is released. At this point, the engaging elements 32 are now aligned with the small diameter portion 332 as shown in FIG. 8. In this position, the engaging elements 32 are free to pivot toward each other thereby allowing the engaging elements 32 to disengage from the fitting groove 412 and permit the engaging member 30 to be withdrawn from the receiving member 40. The engaging member 30 is thereby separated from receiving member 40, and as a result, the stringed instrument is released from the harness 20.

Although the present invention has been fully described by way of example with reference to the accompanying drawings, various changes and modifications will be apparent to those skilled in the art. Therefore, unless such changes and modifications otherwise depart from the spirit and scope of the present invention, they should be construed as being encompassed by the following appended claims:

I claim:

1. A connector including an engaging member and a receiving member, said engaging member comprising:

a hollow base cylinder;

a hollow insertion cylinder positioned at one end of said base cylinder and having an interior peripheral surface, an open end, and at least one through opening;

a shaft, rotatably mounted in said base cylinder, having a first end and a second end, said second end extending into said open end of said insertion cylinder, wherein said second end has a cross-sectional configuration having a large diameter portion which is complementary to an interior peripheral surface of said insertion cylinder and a small diameter portion which is spaced from said interior peripheral surface of said insertion cylinder;

a knob mounted on said first end of said rotatable shaft;

at least one engaging element having a first end and a second end, said at least one engaging element being pivotally mounted in said at least one opening through said insertion member at said first end, and said second end of said at least one engaging element having an outwardly extending arc shaped contour, and said receiving member comprising:

a hollow receiving cylinder having an open end and an annular fitting groove formed in an inner peripheral wall of said hollow receiving cylinder.

2. The connector as claimed in claim 1, wherein said cross-sectional configuration of said rotatable shaft has a shape of a rectangle and said open end of said hollow receiving cylinder is defined by an inwardly tapering guide surface.

3. The connector as claimed in claim 1, further comprising:

a threaded portion formed on an exterior portion of said base cylinder;

a first flange fixed on an exterior surface of said base cylinder; and a second flange rotatably engaging said threaded portion of said base cylinder, wherein said second flange is axially movable along said base cylinder toward and away from said first flange.

4. The connector as claimed in claim 1, further comprising a ring engaging an outer peripheral surface of said insertion cylinder and limiting pivotal movement of said at least one engaging element.

5. The connector as claimed in claim 1, wherein said at least one through opening comprises a pair of diametrically opposed openings and said a least one engaging element comprises a pair of engaging elements pivotally mounted in one of said pair of diametrically opposed through openings.

6. The connector as claimed in claim 5, further comprising a spring operatively engaged with said base cylinder and said rotatable shaft to bias said rotatable shaft into a position where said large diameter portion engages said engaging elements, wherein said second end of each of said engaging elements engages said fitting groove when said insertion cylinder is inserted in said receiving member.

7. The connector as claimed in claim 6, further comprising:

a stopper fixed to an inner peripheral surface of said base cylinder; and a notch formed through a predetermined angle in a peripheral surface of said rotatable shaft and having first and second end walls, wherein said stopper extends into said notch.

8. The connector as claimed in claim 7, wherein said spring biases said rotatable shaft into a radial position where said stopper engages said first end wall of said notch and said large diameter portion engages said engaging elements.

9. The connector as claimed in claim 8, wherein said knob is rotatable, against the bias of said spring, through an angle defined by an engagement of said stopper with said second end wall of said notch.

10. The connector as claimed in claim 9, wherein said small diameter portion of said rotatable shaft is in alignment with said engaging elements when said stopper is in engagement with said second end wall of said notch.

11. A connector for connecting a harness with an instrument, said connector including an engaging member and a receiving member, said engaging member comprising:

a hollow base cylinder;

a hollow insertion member for engaging said receiving member, said insertion member being positioned at one end of said base cylinder and having an interior peripheral surface, an open end and at least one through opening;

a shaft, rotatably mounted in said base cylinder, having a first end and a second end extending into said open end of said insertion member;

means, connected between said shaft and said hollow base cylinder, for resiliently biasing said shaft in a predetermined rotational direction;

at least one engaging element having a first end and a second end, said at least one engaging element being pivotally mounted in said at least one through opening in said insertion member at said first end, and said second end of said at least one engaging element having an outwardly projecting exterior surface for engaging said receiving member, and said receiving member comprising:

a hollow cylindrical shaped member having an open end and means for engaging said second ends of said engaging elements.

12. The connector as claimed in claim 11, further comprising:

a means for connecting a harness to said base cylinder; and a means for mounting said receiving member to an instrument.

13. The connector as claimed in claim 12, wherein said means for connecting a harness to said base cylinder comprises a first flange fixed on said base cylinder and a second flange rotatably mounted on said base cylinder.

14. The connector as claimed in claim 11, further comprising means, provided on said insertion member, for controlling outward movement of said engaging elements.

15. The connector as claimed in claim 14 wherein said means for controlling outward movement of said engaging elements comprises a ring engaging an external peripheral surface of said insertion member.

16. The connector as claimed in claim 11, further comprising means for mounting said receiving member to a stringed instrument, said mounting means being positioned in a second end of said hollow cylindrical shaped member.

17. The connector as claimed in claim 16, wherein said mounting means comprises a screw.

18. The connector as claimed in claim 11, further comprising means, provided between said rotatable shaft and said base cylinder, for limiting rotational movement of said rotatable shaft through a predetermined angle.

19. The connector as claimed in claim 18, wherein said rotational limiting means comprises:

a stopper, mounted on one of rotatable shaft and said base cylinder; and a notch, receiving said stopper, and formed on the other of said rotatable shaft and said base cylinder.

20. The connector as claimed in claim 18, wherein said at least one through opening comprises a pair of diametrically opposed through openings and said a least one engaging element comprises a pair of engaging elements each being pivotally mounted in one of said pair of diametrically opposed through openings.

21. The connector as claimed in claim 20, wherein said rotation limiting means defines a first position at which said second end of said rotatable shaft engages said engaging elements and a second position where said second end of said rotatable shaft is out of engagement with said engaging elements.

* * * * *